US007247788B2

(12) United States Patent
Lai

(10) Patent No.: US 7,247,788 B2
(45) Date of Patent: Jul. 24, 2007

(54) INTEGRATED COMPUTER AND MUSIC KEYBOARD MODULE

(75) Inventor: Lai-Chen Lai, Yonghe (TW)

(73) Assignee: Mitac Technology Corp., Hsin-Chu Hsien (TW)

( * ) Notice: Subject to any disclaimer, the term of this patent is extended or adjusted under 35 U.S.C. 154(b) by 85 days.

(21) Appl. No.: 11/128,276

(22) Filed: May 13, 2005

(65) Prior Publication Data

US 2006/0117939 A1 Jun. 8, 2006

(30) Foreign Application Priority Data

Dec. 6, 2004 (TW) ..... 93137667 A

(51) Int. Cl.
*G10H 1/32* (2006.01)

(52) U.S. Cl. ..... 84/719; 84/720; 84/744; 84/745

(58) Field of Classification Search ..... None
See application file for complete search history.

(56) References Cited

U.S. PATENT DOCUMENTS 5,507,215 A * 4/1996 Lin ..... 84/423 R
5,616,897 A * 4/1997 Weber et al. ..... 200/5 A
5,969,283 A * 10/1999 Looney et al. ..... 84/609
5,971,635 A * 10/1999 Wise ..... 400/473
6,259,006 B1 * 7/2001 Parienti ..... 84/171
2002/0144586 A1 * 10/2002 Connick, Jr. ..... 84/478
2004/0083877 A1 * 5/2004 Bubar ..... 84/423 R
2004/0173085 A1 * 9/2004 Seow et al. ..... 84/744
2004/0231500 A1 * 11/2004 Sim et al. ..... 84/719
2004/0231501 A1 * 11/2004 Sim et al. ..... 84/719
2005/0056144 A1 * 3/2005 Yang et al. ..... 84/719
2005/0087061 A1 * 4/2005 Sim et al. ..... 84/719
2006/0243119 A1 * 11/2006 Rubang, Jr. ..... 84/609

* cited by examiner

*Primary Examiner*—Marlon Fletcher
(74) *Attorney, Agent, or Firm*—Rosenberg, Klein & Lee

(57) ABSTRACT

An integrated computer and music keyboard module includes a key assembled base, on a first side of which a plurality of music keys are parallelly arranged. The key assembled base is provided on at least one lateral end with a connecting member for turnably connecting at least one extended module thereto. The extended module includes an extended key assembled base, on a first side of which a plurality of music keys are arranged, and on a second side of which a plurality of computer keys are arranged. When the extended module is turned about the connecting member to an extended position, a music keyboard is shown; and when the extended module is turned to a folded position, the computer keys are exposed to serve as a computer keyboard.

8 Claims, 11 Drawing Sheets

INTEGRATED COMPUTER AND MUSIC KEYBOARD MODULE

FIELD OF THE INVENTION

The present invention relates to an integrated computer and music keyboard module, and more particularly to an integrated computer and music keyboard module that normally serves as a keyboard of a computer and could be extended to present a music keyboard for playing or composing music on the computer.

BACKGROUND OF THE INVENTION

A keyboard is an important input device for a computer. All data, including numerics, characters, control instructions, etc., are input to the computer via the keyboard. A desktop computer generally includes a keyboard configured as a separate module, which is connected to a keyboard connecting port on the computer case of the computer via a cable having a connector provided thereon. Currently, there is also developed a keyboard for wirelessly connecting to the host of the computer using the wireless transmission technique.

For a notebook computer, the keyboard is normally fitted on the computer case of the notebook computer for a user to input numerics, characters, and/or control instructions to the computer.

In recent years, audio-visual equipment has been integrated into the computer, enabling the computer to serve as a multimedia player. A lover of music may purchase a separate music keyboard and connect the same to the computer, so as to play or compose music on the computer using relevant applications for such purposes.

While the computer may be provided with the function of multi-media player by connecting a music keyboard thereto, the user has to additionally purchase the separate music keyboard, and the music keyboard and the original computer keyboard are two completely separate input devices. For the users of notebook computers, it is not only uneconomical to expend extra money to purchase the additional music keyboard, but also very troublesome to manage or carry two different input devices.

In a further analysis of key type and function of the computer and music keyboards, it is found signals generated via depressing of keys on the two types of keyboards all are processed in a simple way and then sent to the computer, though the two types of keyboards have different key arrangements. Thus, it would be a great convenience to users if the computer and the music keyboard were integrated into one single input module.

SUMMARY OF THE INVENTION

A primary object of the present invention is to provide an integrated computer and music keyboard module in which a keyboard generally equipped with a computer and a general music keyboard are included.

Another object of the present invention is to provide an integrated computer and music keyboard module that is foldable. When the keyboard module is in a completely folded state, it serves as a standard computer keyboard for a user to input different data, including numerics, characters, control instructions, etc., to a computer connected therewith; and when the keyboard module is in a completely extended state, it serves as a music keyboard for a user to play or compose music on the computer using relevant applications.

To achieve the above objectives, in accordance with the present invention, an integrated computer and music keyboard module includes a key assembled base, on a first side of which a plurality of music keys are parallelly arranged. The key assembled base is provided on at least one lateral end with a connecting member for turnably connecting at least one extended module thereto. The extended module includes an extended key assembled base, on a first side of which a plurality of music keys are arranged, and on a second side of which a plurality of computer keys are arranged. When the extended module is turned about the connecting member to an extended position, a music keyboard is shown; and when the extended module is turned to a folded position, the computer keys are exposed to serve as a computer keyboard.

With the integrated computer and music keyboard module of the present invention, a user may selectively extend or fold the keyboard module depending on actual need. The integrated keyboard module serves as a music keyboard when it is extended, and a computer keyboard when it is folded. The user may save the money that is otherwise expended to additionally purchase a separate music keyboard, and the integrated keyboard module is more convenient for carrying, particularly to a user of notebook computer.

BRIEF DESCRIPTION OF THE DRAWINGS

The structure and the technical means adopted by the present invention to achieve the above and other objects can be best understood by referring to the following detailed description of the preferred embodiments and the accompanying drawings, wherein.

DETAILED DESCRIPTION OF THE PREFERRED EMBODIMENTS

Figure 1:
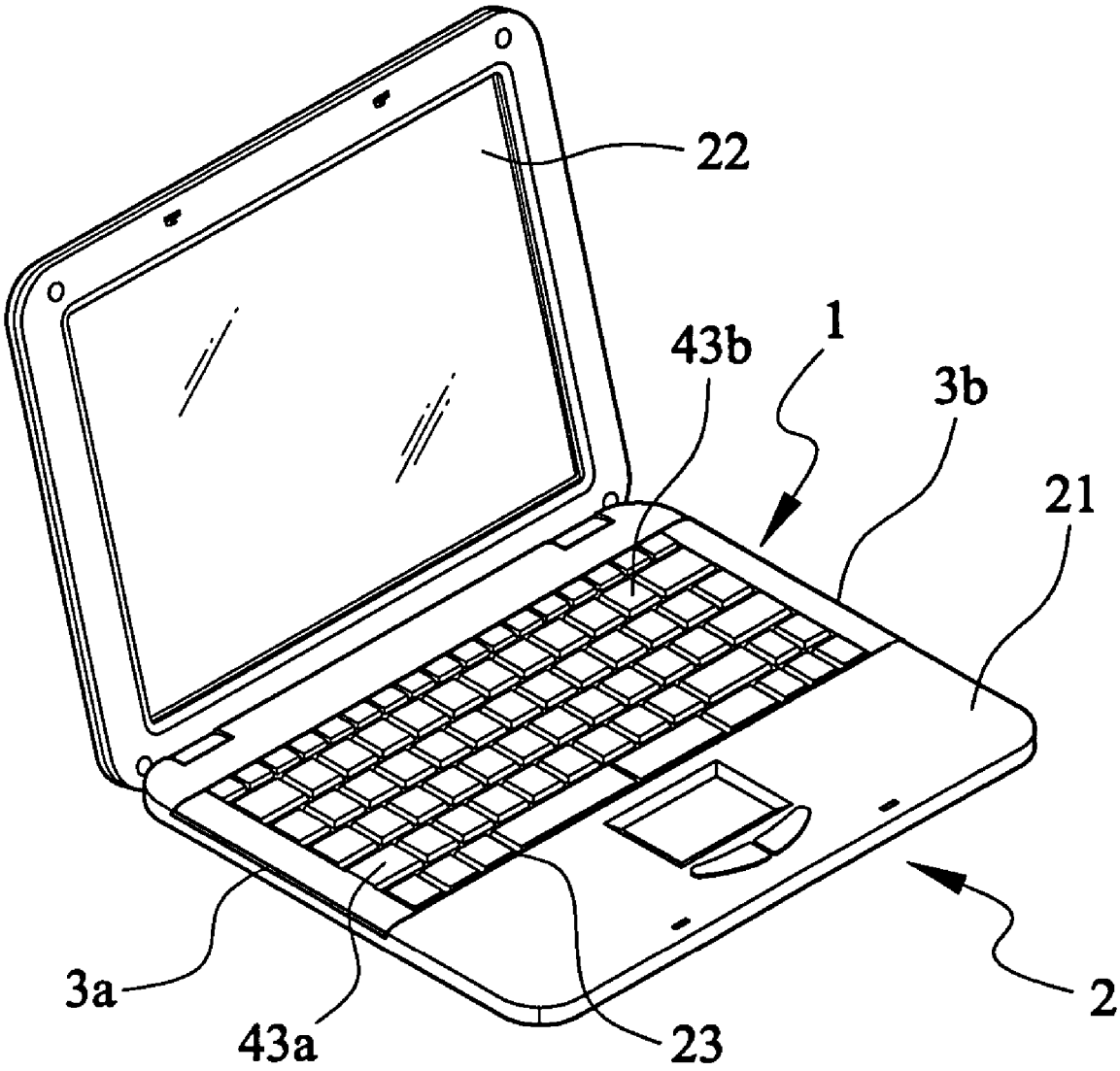
FIG. 1 is a perspective view of a notebook computer equipped with an integrated computer and music keyboard module according to a first embodiment of the present invention.
Figure 2:
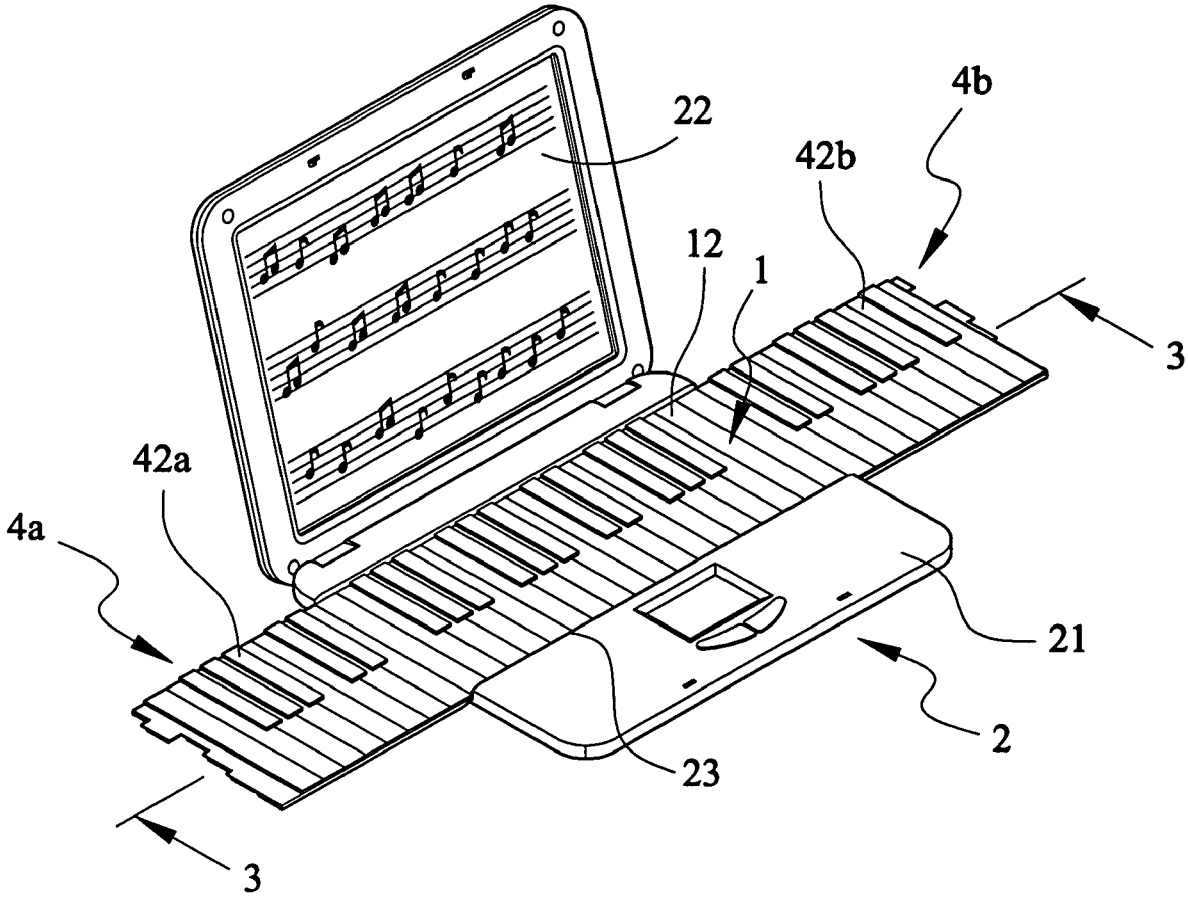
FIG. 2 is a perspective view showing the integrated computer and music keyboard module on the notebook computer of FIG. 1 is extended to show the music keyboard thereof.

Please refer to FIG. 1 that is a perspective view of a notebook computer 2 equipped with an integrated computer and music keyboard module 1 according to a first embodiment of the present invention, and to FIG. 2 that shows the integrated computer and music keyboard module 1 on the notebook computer 2 of FIG. 1 is extended to show a music keyboard thereof. As shown, the notebook computer 2 includes a computer case 21 and a display screen 22. The integrated computer and music keyboard module 1 of the present invention is firmly fitted in a recess 23 provided on the computer case 21.

Figure 3:
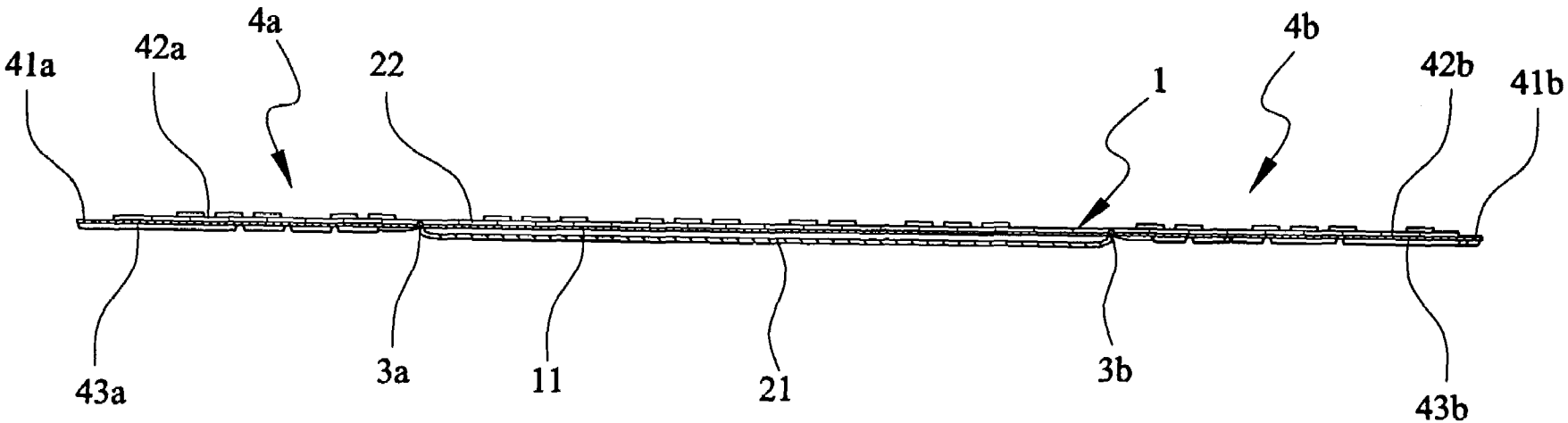
FIG. 3 is a sectional view taken along line 3-3 of FIG. 2.

Please refer to FIG. 3 that is a sectional view taken along line 3-3 of FIG. 2. As shown, the integrated computer and music keyboard module 1 of the present invention includes a key assembled base 11, a first or upper side of which has a plurality of parallelly arranged music keys 12 provided thereon, and a second or lower side of which is fixed to the computer case 21 at a position at where a standard keyboard is normally located.

The key assembled base 11 is provided at two lateral ends with a connecting member 3*a*, 3*b* each for connecting two extended modules 4*a*, 4*b* to the two lateral ends of the key assembled base 11. The extended module 4*a* includes an extended key assembled base 41*a*, a first or upper side of which has a plurality of parallelly arranged music keys 42*a*, and a second or lower side of which has a plurality of computer keys 43*a*. Similarly, the extended module 4*b* includes an extended key assembled base 41*b*, a first or upper side of which has a plurality of parallelly arranged music keys 42*b*, and a second or lower side of which has a plurality of computer keys 43*b*.

Figure 4:
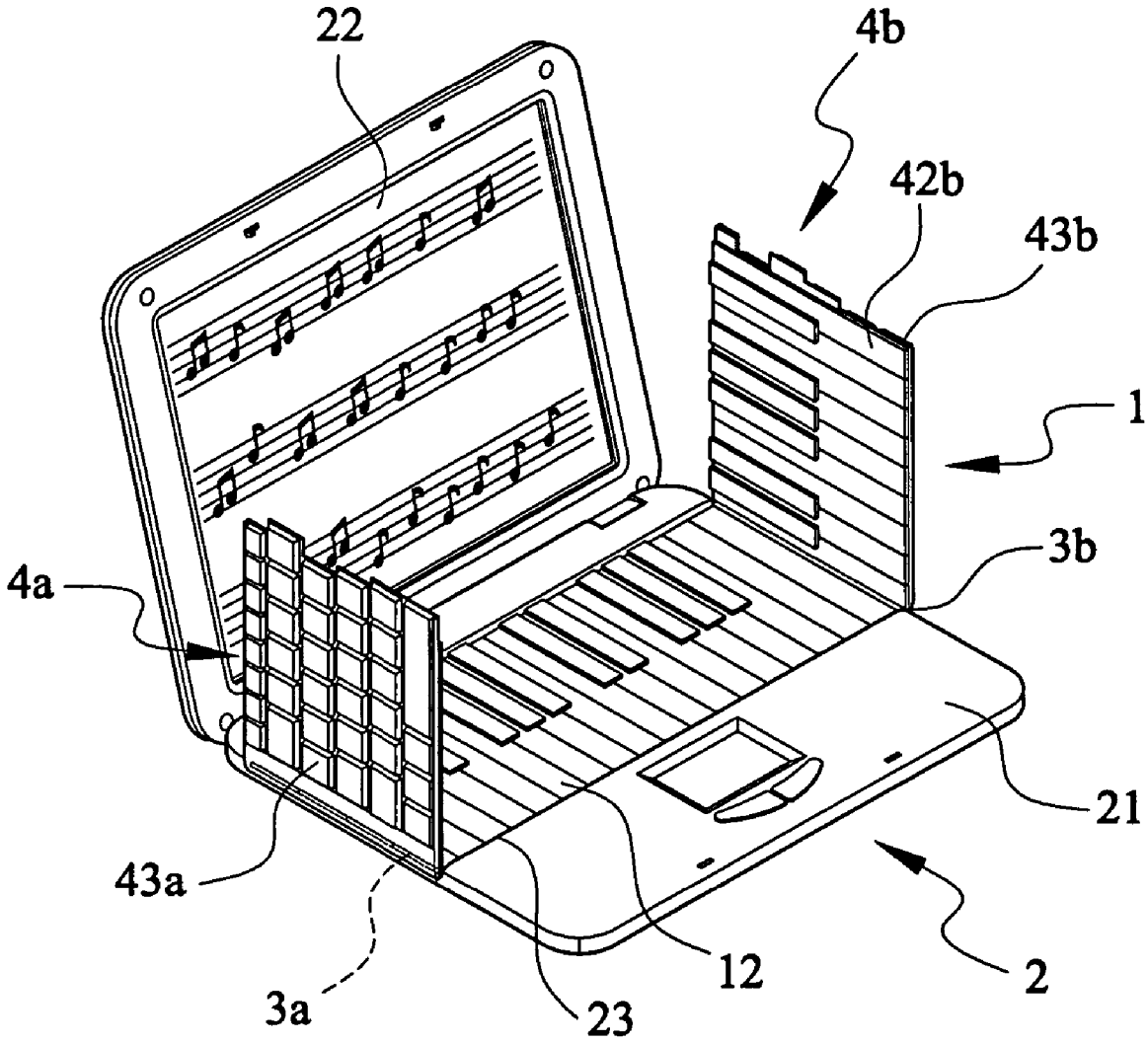
FIG. 4 is a perspective view showing the integrated computer and music keyboard module mounted on the notebook computer of FIG. 1 is foldable to show the computer keyboard thereof.

In a preferred embodiment of the present invention, the extended modules 4*a*, 4*b* may be folded to lie on two lateral halves of the upper side of the key assembled base 11 by upward turning the extended modules 4*a*, 4*b* about the connecting members 3*a*, 3*b*, respectively, as shown in FIG. 4.

When the two extended modules 4*a*, 4*b* are folded to lie on the upper side of the key assembled base 11, the computer keys 43*a*, 43*b* provided on the lower sides of the extended key assembled bases 41*a*, 41*b* of the extended modules 4*a*, 4*b*, respectively, together make up a standard computer keyboard, as shown in FIG. 1. A user may execute various input functions, such as entering numerics and characters, on the notebook computer 2 via the computer keyboard of the integrated computer and music keyboard module 1.

Figure 5:
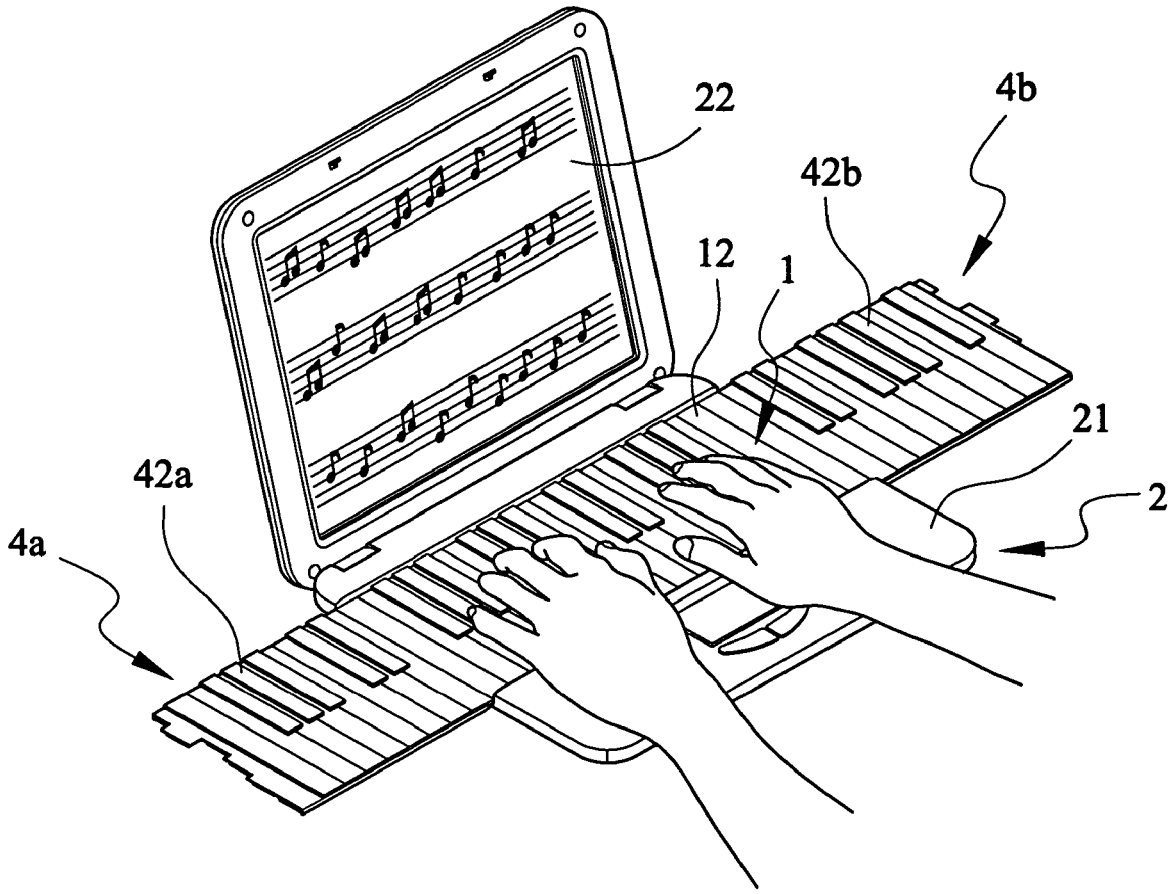
FIG. 5 is a perspective view showing the use of the music keyboard of the integrated computer and music keyboard module of the present invention to play music.
Figure 6:
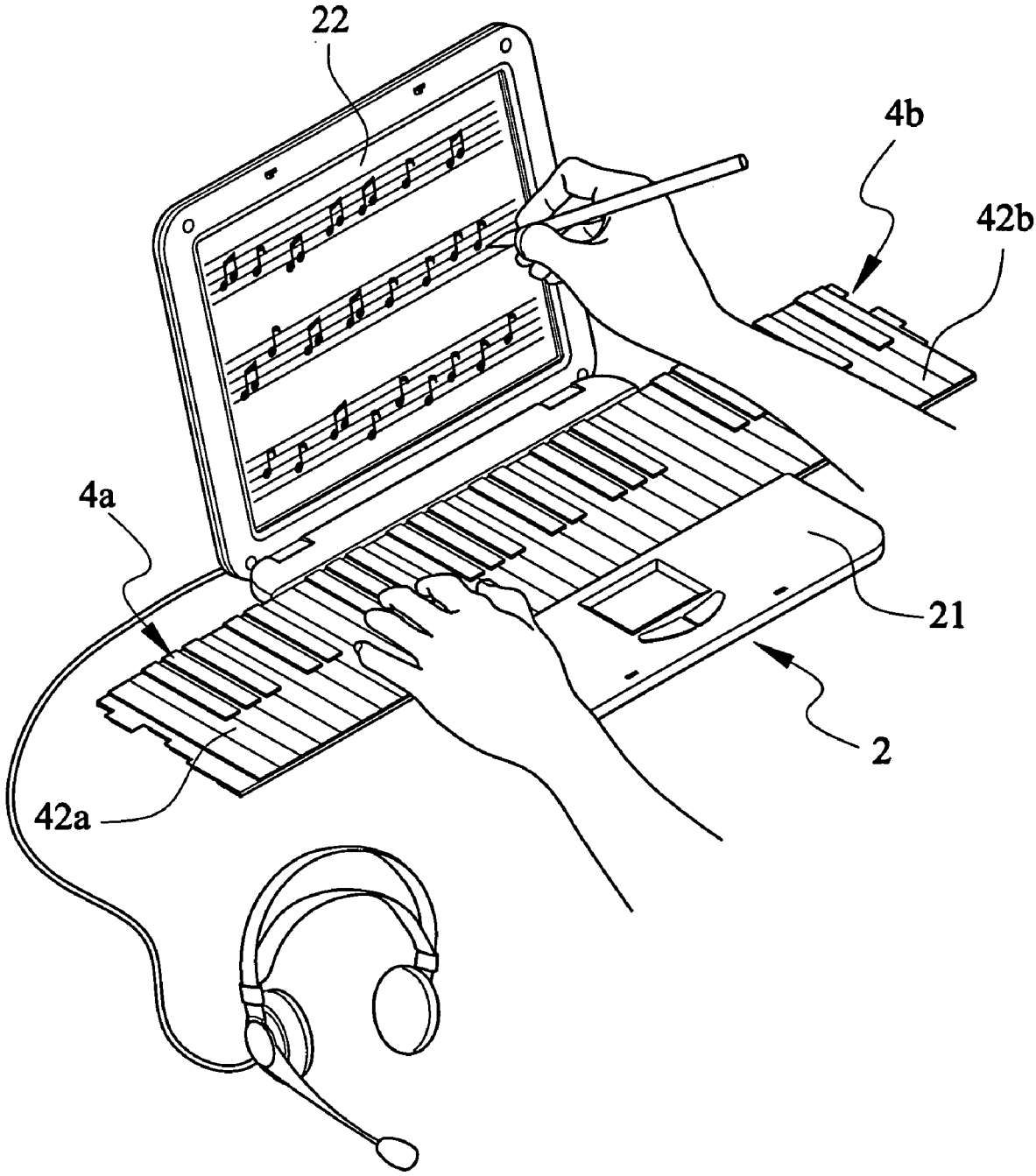
FIG. 6 is a perspective view showing the use of the music keyboard of the integrated computer and music keyboard module of the present invention to compose music on a computer.

On the other hand, when the two extended modules 4*a*, 4*b* at the two lateral ends of the key assembled base 11 are outward turned about the connecting members 3*a*, 3*b* to an extended position, the music keys 12 on the upper side of the key assembled base 11 and the music keys 42*a*, 42*b* on the upper sides of the extended key assembled bases 41*a*, 41*b* are exposed to together make up a music keyboard, as shown in FIG. 2. At this point, a user may play music by operating the music keyboard and using relevant multimedia programs installed on the notebook computer 2 as well as musical notes shown on the display screen 22, as shown in FIG. 5. Or, the user may compose music on the display screen 22 or listen music on the computer 2 by operating the music keyboard and using relevant music composing applications, as shown in FIG. 6.

Figure 7:
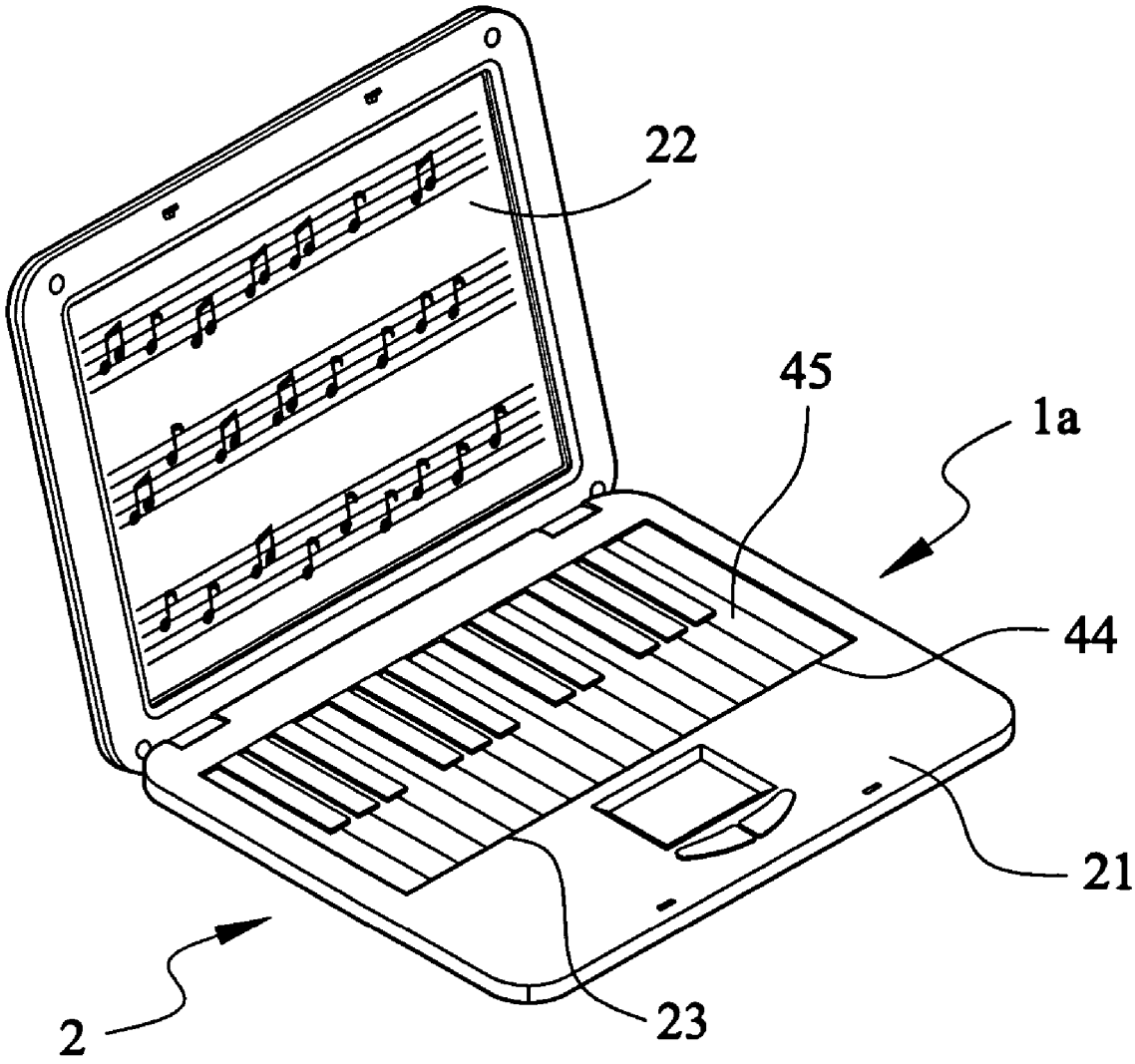
FIG. 7 is a perspective view of an integrated computer and music keyboard module according to a second embodiment of the present invention mounted on a notebook computer, wherein a plurality of parallelly arranged music keys are presented on the computer case of the notebook computer.
Figure 8:
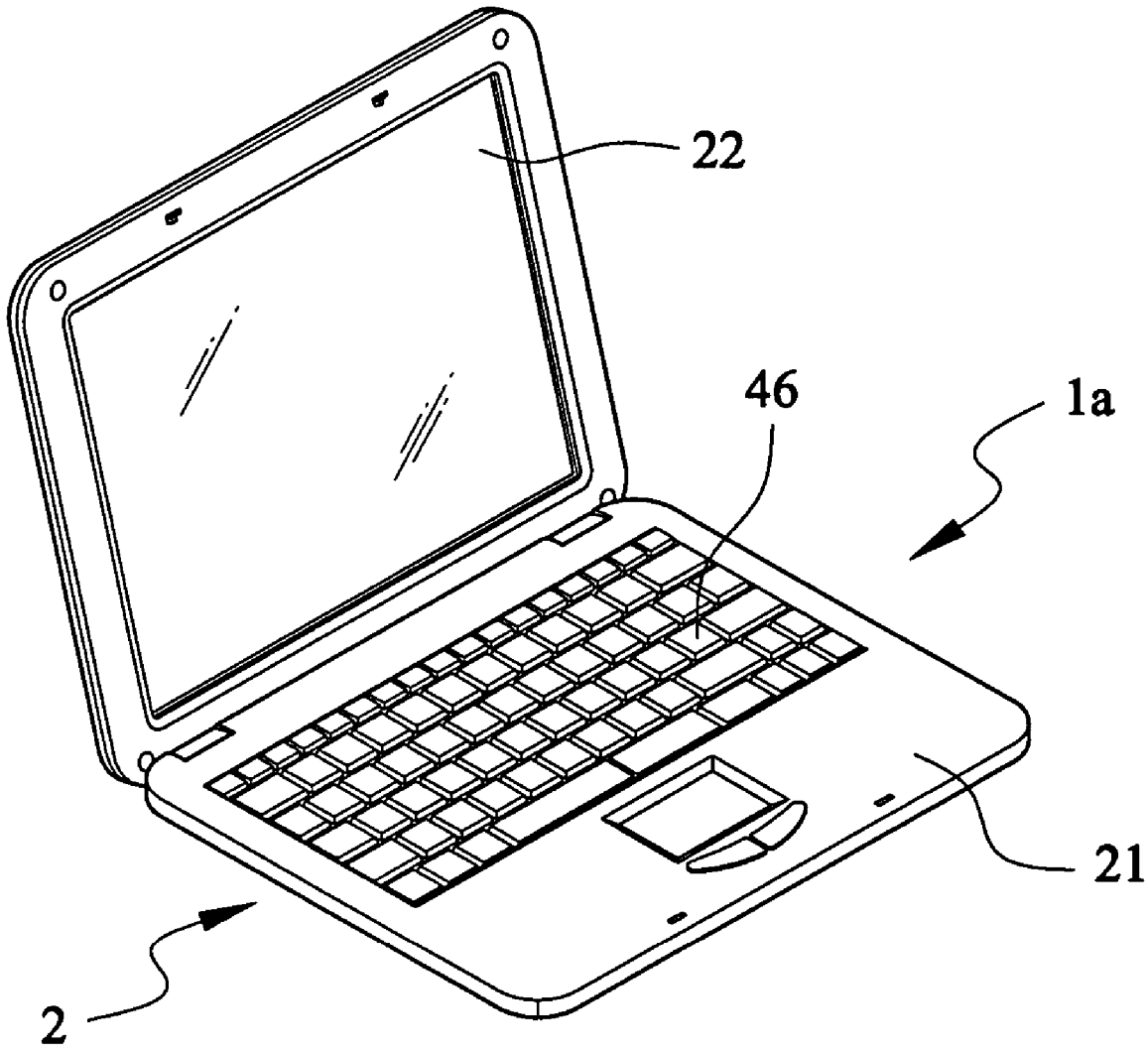
FIG. 8 is another perspective view of the integrated computer and music keyboard module according to the second embodiment of the present invention mounted on the notebook computer of FIG. 7, wherein a plurality of parallelly arranged computer keys are presented on the computer case of the notebook computer.

FIGS. 7 and 8 shows an integrated computer and music keyboard module 1*a* according to a second embodiment of the present invention. Unlike the first embodiment, the keyboard module 1*a* is non-foldable. The keyboard module 1*a* includes key assembled base 44, a first or upper side of which is provided with a plurality of parallelly arranged music keys 45, as shown in FIG. 7, and a second or lower side of which is provided with a plurality of computer keys 46, as shown in FIG. 8.

When the integrated computer and music keyboard module 1*a* is fitted on the computer case 21 of the notebook computer 2 with the first or upper side of the key assembled base 44 facing upward, as shown in FIG. 7, a user may execute the function of playing or composing music on the computer 2 through operating the music keys 45 and using relevant multimedia programs installed on the computer 2 as well as musical notes shown on the display screen 22.

On the other hand, when the integrated computer and music keyboard module 1*a* is fitted on the computer case 21 of the notebook computer 2 with the second or lower side of the key assembled base 44 facing upward, as shown in FIG. 8, a user may execute various input functions, such as entering numerics and characters, on the notebook computer 2 via the computer keys 46 just like on a general standard computer keyboard.

Figure 9:
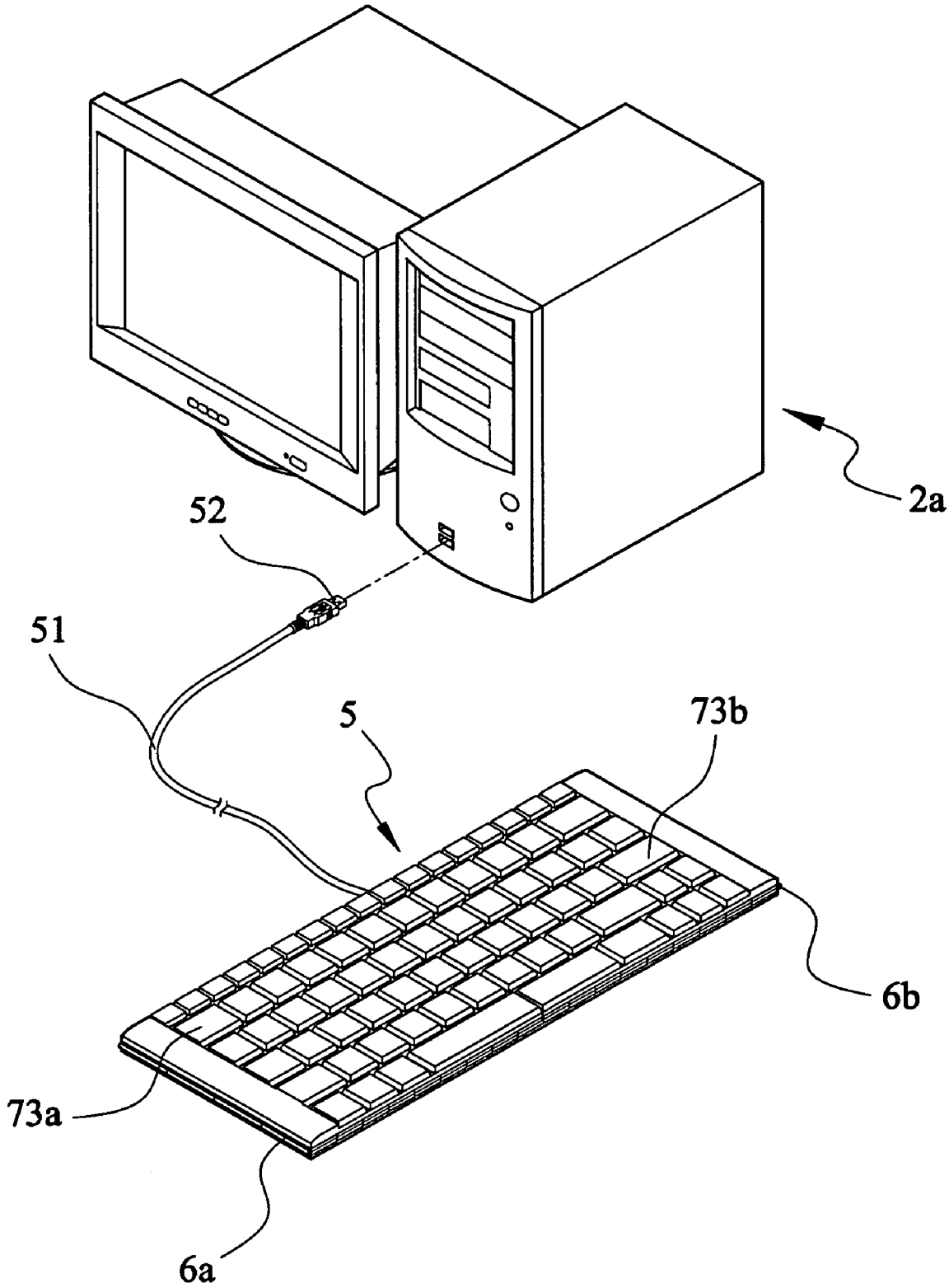
FIG. 9 is perspective view of an integrated computer and music keyboard module according to a third embodiment of the present invention.

FIG. 9 is a perspective view showing an integrated computer and music keyboard module 5 according to a third embodiment of the present invention. The integrated computer and music keyboard module 5 is a separate module connected to a general notebook computer or a desktop computer 2*a* via a cable 51 having a connector 52 provided at an end thereof. The connector 52 may be a conventional PS/2 connector or a USB connector.

Alternatively, the integrated computer and music keyboard module 5 may be designed for wirelessly transmitting signals to the computer 2*a* via infrared ray or radio frequency (RF). And, the computer keys and the music keys on the keyboard module 5 may be traditional mechanical keys or membrane keys.

Figure 10:
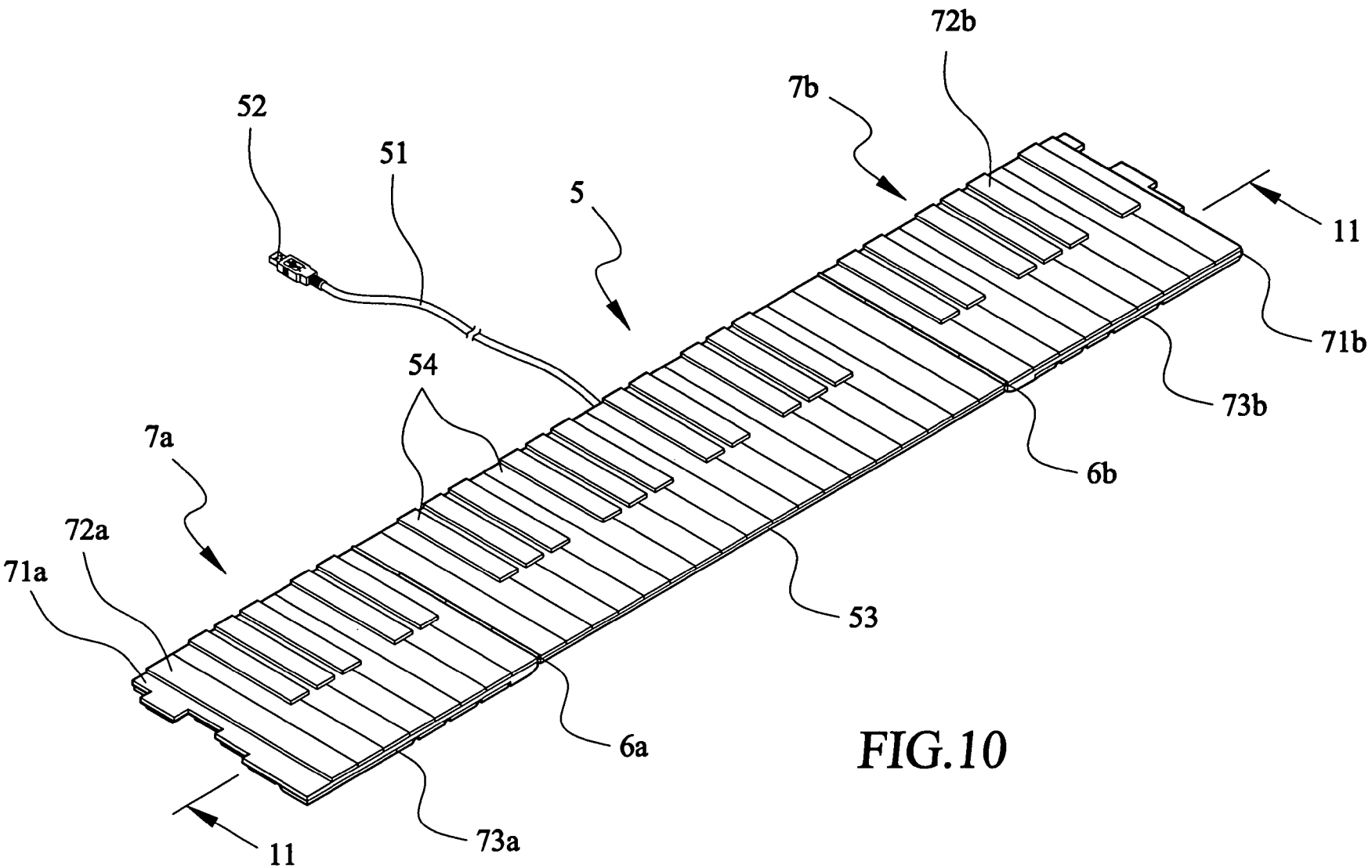
FIG. 10 is a perspective view of the integrated computer and music keyboard module of FIG. 9 in a fully extended state.
Figure 11:
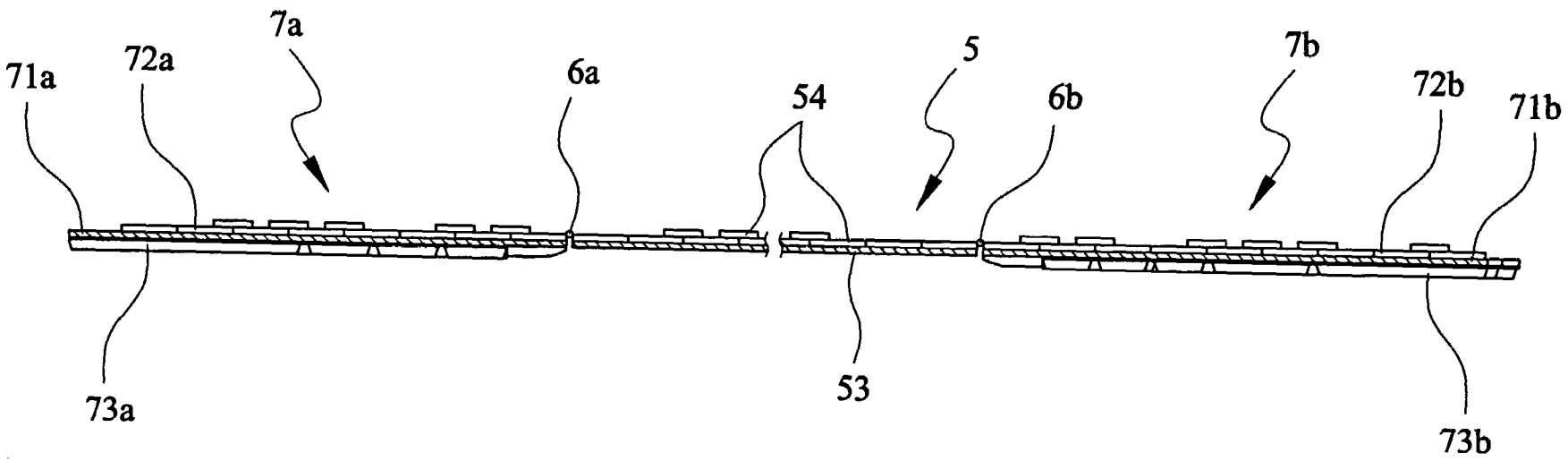
FIG. 11 is a sectional view taken along line 11-11 of FIG. 10.

Please refer to FIG. 10 that is a perspective view of the integrated computer and music keyboard module 5 of FIG. 9 in an extended state, and to FIG. 11 that is a sectional view taken along line 11-11 of FIG. 10. As shown, the integrated computer and music keyboard module 5 according to the third embodiment of the present invention includes a key assembled base 53, a first or upper side of which has a plurality of parallelly arranged music keys 54, and a second or lower side of which is designed for laying on a desk top.

The key assembled base 53 is provided at two lateral ends with a connecting member 6*a*, 6*b* each for connecting two extended modules 7*a*, 7*b* to the two lateral ends of the key assembled base 53. The extended module 7*a* includes an extended key assembled base 71*a*, a first or upper side of which has a plurality of parallelly arranged music keys 72*a*, and a second or lower side of which has a plurality of computer keys 73*a*. Similarly, the extended module 7*b* includes an extended key assembled base 71*b*, a first or upper side of which has a plurality of parallelly arranged music keys 72*b*, and a second or lower side of which has a plurality of computer keys 73*b*.

In a preferred embodiment of the present invention, the extended modules 7*a*, 7*b* may be folded to lie on two lateral halves of the upper side of the key assembled base 53 by upward turning the extended modules 7*a*, 7*b* about the connecting members 6*a*, 6*b*, respectively.

When the two extended modules 7*a*, 7*b* are folded to lie on the upper side of the key assembled base 53, the computer keys 73*a*, 73*b* provided on the lower sides of the extended key assembled bases 71*a*, 71*b* of the extended modules 7*a*, 7*b*, respectively, together make up a standard computer keyboard, as shown in FIG. 9. A user may execute various input functions, such as entering numerics and characters, on the computer 2*a* via the computer keyboard of the integrated computer and music keyboard module 5.

On the other hand, when the two extended modules 7*a*, 7*b* at the two lateral ends of the key assembled base 53 are outward turned about the connecting members 6*a*, 6*b* to an extended position, the music keys 54 on the upper side of the key assembled base 53 and the music keys 72*a*, 72*b* on the upper sides of the extended key assembled bases 71*a*, 71*b* are exposed to together make up a music keyboard, as shown in FIG. 10.

The present invention has been described with some preferred embodiments thereof used with a notebook or a desktop computer, and it is understood that the present invention may be otherwise used with other digital apparatus, such as palmtop computers, personal digital assistants (PDA), and other communicating apparatus, and that many changes and modifications in the described embodiments can be carried out without departing from the scope and the spirit of the invention that is intended to be limited only by the appended claims.

What is claimed is:

1. An integrated keyboard module electrically coupled to a computer to serve as an input device of the computer, comprising:

a key assembled base having a first and a second side, the first side of the key assembled base having a plurality of music keys arranged parallel one to another thereon;

an extended module having an extended key assembled base connected to each of a first lateral end and a second lateral end of the key assembled base, the extended key assembled base having a first and a second side, the first side having a plurality of music keys arranged thereon, and the second side having a plurality of computer keys arranged thereon, wherein the extended module at each of the first lateral end and the second lateral end is rotatably displaceable to overlay the key assembled base to form thereby a computer keyboard and is rotatably displaceable into coplanar adjacency with the key assembled base to form thereby a music keyboard; and foldable connecting members for rotatably connecting the extended module to each of the first lateral end and the second lateral end of the key assembled base.

2. The integrated keyboard module as claimed in claim 1, wherein the computer is a notebook computer, and wherein the second side of the key assembled base is fixedly fitted on a computer case of the notebook computer.

3. The integrated keyboard module as claimed in claim 1, further comprising a cable having a connector provided thereon for connecting the integrated computer and music keyboard module to the computer.

4. A digital system comprising:

a digital apparatus provided with a case and a display screen;

a recess formed on the case of the digital apparatus;

an integrated computer and music keyboard module with a key assembled base having a first and a second side;

a plurality of music keys disposed in parallel relationship one to another on the first side of the key assembled base; and a plurality of computer keys disposed on the second side of the key assembled base, wherein the computer and music keyboard module is inserted into the recess with the first or the second side of the key assembled base selectively outwardly facing.

5. The digital system as claimed in claim 4, wherein the digital apparatus is a notebook computer.

6. The digital system as claimed in claim 4, wherein the digital apparatus is a palmtop computer.

7. The digital system as claimed in claim 4, wherein the digital apparatus is a personal digital assistant.

8. The digital system as claimed in claim 4, wherein the digital apparatus is a communicating device.

* * * * *